United States Patent [19]

Croxall

[11] Patent Number: 4,635,551

[45] Date of Patent: Jan. 13, 1987

[54] METHOD OF PRINTING HOSIERY

[75] Inventor: John Croxall, Dadlington, Nr. Nuneaton, England

[73] Assignee: Couture Marketing Limited, Leicestershire, England

[21] Appl. No.: 750,866

[22] Filed: Jul. 1, 1985

[30] Foreign Application Priority Data

Feb. 20, 1985 [GB] United Kingdom ..... 8504345

[51] Int. Cl.[4] ..... B41F 17/38

[52] U.S. Cl. ..... 101/470; 101/35; 8/471; 156/240

[58] Field of Search ..... 101/35, 470, 426; 8/471, 472; 156/240, 230, 277, 294, 229

[56] References Cited

U.S. PATENT DOCUMENTS

| | | | |
|---|---|---|---|
| 1,617,123 | 2/1927 | Kaufmann | 101/35 X |
| 2,073,379 | 3/1937 | Rasmussen | 101/35 X |
| 4,030,962 | 6/1977 | Fitzwater | 101/470 X |

FOREIGN PATENT DOCUMENTS

| | | | |
|---|---|---|---|
| 2139776 | 1/1973 | France | 101/470 |
| 2352096 | 12/1977 | France | 101/35 |
| 1425345 | 2/1976 | United Kingdom | 101/470 |

*Primary Examiner*—Clifford D. Crowder

*Attorney, Agent, or Firm*—Basile, Weintraub & Hanlon

[57] ABSTRACT

In a method of printing hosiery, a hose tube is placed over a flat form having a pair of side edges which taper towards each other at a predetermined angle, at least one of these edges being substantially straight. There is then placed over the hose tube on the form a print carrier which is initially in the form of a frustoconical tube but which is flattened along two opposed fold lines. These fold lines also taper towards each other at the said predetermined angle so that the print carrier fits snugly over the flat form. The hose tube is contacted closely between the fold lines and the side edges of the form during a subsequent hot pressing operation, so that a design carried by the print carrier is properly transferred to the hose tube and there is no resultant discontinuity in design in the finished hosiery in those areas.

5 Claims, 4 Drawing Figures

METHOD OF PRINTING HOSIERY

BACKGROUND OF THE INVENTION

Field of the Invention

This invention relates to the printing of hosiery.

Description of Prior Art

In the production of hosiery, it is often desired to create a decorative pattern on the finished article by printing, the printing process being performed either during or after fabrication. Conventionally, the printing process is carried out by first placing sheets of a print carrier (such as printing paper) on either side of the form, followed by a hot pressing operation to transfer the print from the carrier to the hosiery. However, this process results in discontinuities in or a mismatching of the printed pattern along lines where the hosiery passes around the side edges of the form, giving rise to poor aesthetic appearance of the finished article.

Attempts have been made to obviate this problem by using a single sheet of print carrier folded in two, rather than two separate sheets of print carrier. The sheet is placed so that its fold line runs along one side edge of the form, the intention being that the printed pattern will be carried continuously around that edge. Although a discontinuity will still occur at the other side of the form, this will normally be in an area of the hosiery where a mismatch in the pattern can be accepted, such as along the rear of the hosiery leg. In practice, however, it is found that the squeezing action imposed by the hot pressing process causes the fold in the print carrier to separate from the side edge of the form and from the hosiery thereon, so that a discontinuity of pattern is still processed in the finished article.

SUMMARY OF THE INVENTION

It is an object of the present invention to overcome the above-mentioned problems.

According to the invention, there is provided a method of printing hosiery, comprising placing a hose over a flat form having a pair of side edges which taper towards each other at a predetermined angle, at least one of these side edges being substantially straight, placing a print carrier over the hose on the form, the print carrier being in the form of a frustoconical tube shaped so that, at least as it is placed over the form, it becomes flattened along two opposed fold lines which taper towards each other substantially at the same predetermined angle as the side edges of the form, such that the hose becomes closely contacted both by the side edges of the form and by the fold lines of the print carrier, and then transferring print from the print carrier to the hose.

In an ideal situation, both side edges of the form will be substantially straight. In a practical embodiment, however, one of the side edges is substantially straight and the other side edge is composed of a substantially straight portion (on which a calf portion of the hose is received) which tapers as aforesaid relative to said one side edge, and a configurated portion (on which a foot portion of the hose is received) whose lateral extent is confined to within an imaginary line forming an extension of the substantially straight portion.

Preferably, vents are provided at the interface between the side edges of the form and the fold lines of the print carrier to allow the escape of gases therefrom.

These vents advantageously take the form of perforations provided in the print carrier.

BRIEF DESCRIPTION OF DRAWINGS

The invention will now be further described, by way of example only, with reference to the accompanying drawings, in which.

DESCRIPTION OF PREFERRED EMBODIMENTS

Figure 1:
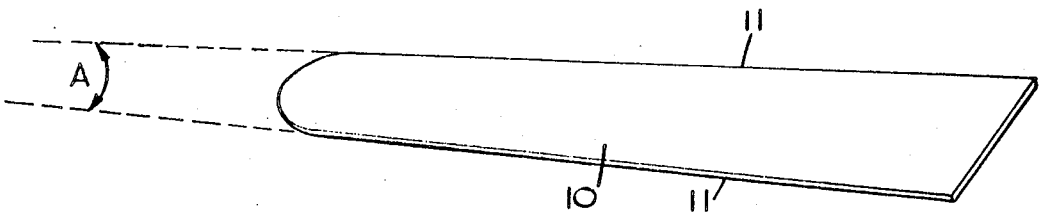
FIGS. 1 to 3 show various stages in a method of printing hosiery according to the present invention, using one type of form.
Figure 2:
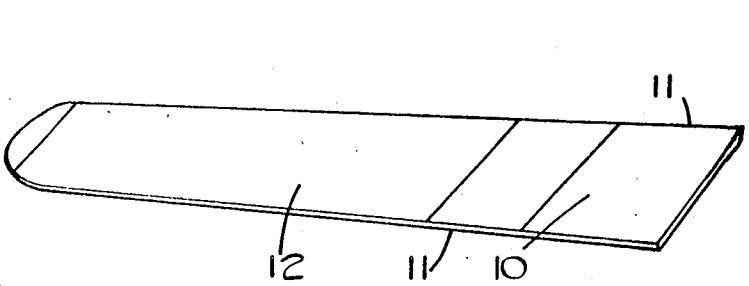
Figure 2:
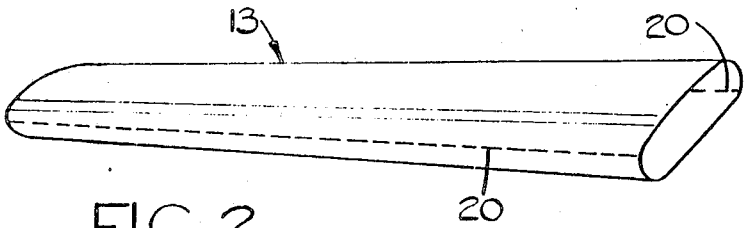

FIG. 1 illustrates a generally flat hosiery form 10 having two opposed side edges 11 which taper towards each other at a predetermined angle A. An item of hosiery 12 which is to be printed with a desired pattern is placed upon the form as indicated in FIG. 2. In general terms, the printing process can be carried out at any convenient stage in the fabrication of the hosiery, and in particular it is immaterial whether the item 12 has been toe seamed at this stage: in the case of panty hose, however, the printing process will be carried out on each leg in turn before these are U-seamed together. For the sake of convenience, item 12 is depicted in the drawings as a simple hose tube.

Figure 3:
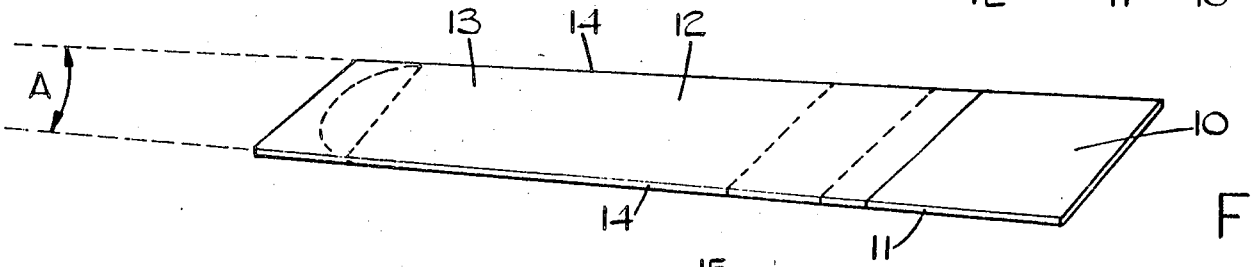

Once suitably positioned on the form 10, a fabricated print carrier 13 is placed over the hose tube 12, as indicated in FIG. 3. The carrier 13 takes the form of a frustoconical tube of printing paper (with the printed surface of the paper facing inwardly) which as it is placed over the form, becomes flattened along two opposed fold lines 14. The shape of the carrier 13 is such that these two fold lines 14 taper towards each other at substantially the same predetermined angle A as the side edges 11 of the form 10. Thus, by pulling the carrier 13 along the form 10 as far as it will go, the hose tube 12 is brought into tight engagement with both the side edges 11 and the fold lines 14, resulting in a firm positive fit of the printing paper over the whole of the surface of the hose tube, including the parts at the side edges of the form. Consequently, when the above-described assembly is subsequently subjected to a hot pressing process to transfer the print from the carrier 13 to the hose tube 12, the printing paper does not become separated from the hose tube at the side edges 11. Therefore, the printed pattern extends continuously around the parts of the hose tube at these side edges, thereby avoiding the previous problems with mismatching of the pattern.

Figure 4:
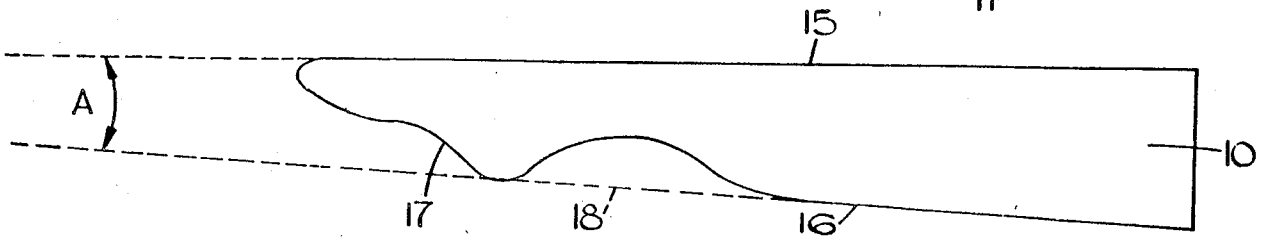
FIG. 4 is a plan view of an alternative type of form for use in the method.

FIG. 4 illustrates an alternative type of form for use particularly where the hose tube 12 has already been toe seamed, and which represents the best shape for presentation and marketing of the finished goods. One side edge 15 of the form is substantially straight as before, while the other side edge is composed of a substantially straight portion 16 (which receives a calf portion of the hose tube) and a configurated portion 17 (which receives a foot portion of the hose tube). In order to ensure that the fabricated print carrier can fit properly over the form 10, the lateral extent of the portion 17 is confined to within an imaginary line 18 forming an extension of the portion 16. In this case, there will of course be some discontinuity in the printed pattern along the edge portion 17, but this is aesthetically acceptable for the same reasons as mentioned previously. Nevetheless, because the side edge 15 and the edge portion 16 taper towards each other at the aforementioned angle A, the print carrier can still be snugly engaged over the hose tube giving a continuity in pattern around those edges.

In cases where the print carrier 13 takes the form of a so-called "sublimation transfer", the printing inks are caused to vaporize by the hot pressing operation so that they become deposited upon the hose tube. This process does involve the generation of various gases which can become trapped between the side edges 11 of the form 10 and the fold lines 14 of the print carrier 13, thereby obstructing the transfer of the printing inks in those areas. To overcome this particular problem, vents can be provided to allow the escape of these gases: preferably the vents take the form of perforations provided in the print carrier 13, for example in the manner depicted at 20 in FIG. 2.

I claim:

1. A method of printing hosiery, comprising the steps of:

(a) providing a flat form having a pair of side edges which taper towards each other at a predetermined angle, at least one of said side edges being substantially straight;

(b) placing a tubular hose over said flat form such that parts of said tubular hose pass around said side edges of said form;

(c) placing over said tubular hose on said flat form a print carrier having a printed design thereon, said print carrier initially being in the form of a frustoconical tube but being flattened along two opposed fold lines which also taper towards each other at said predetermined angle, said parts of said tubular hose being engaged between and closely contacted by said fold lines of said print carrier and said side edges of said form; and (d) transferring said printed design from said print carrier to said tubular hose.

2. The method according to claim 1, wherein a first of said side edges of said form is substantially straight, and a second of said side edges comprises a substantially straight portion which tapers at said predetermined angle relative to said first side edge, and a configurated portion whose lateral extent is confined to within an imaginary line forming an extension of said substantially straight portion.

3. The method according to claim 1, wherein vents are provided at an interface between each said side edge of said form and the respective one of said fold lines of said print carrier, whereby the escape of gases from said interface is permitted.

4. The method according to claim 3, wherein said vents take the form of perforations provided in said print carrier.

5. The method according to claim 1, wherein step (d) is performed by means of a hot pressing operation.

* * * * *